US006170579B1

(12) United States Patent
Wadge

(10) Patent No.: US 6,170,579 B1
(45) **Date of Patent: *Jan. 9, 2001**

(54) POWER TOOL HAVING INTERCHANGEABLE TOOL HEAD

(75) Inventor: Brian Wadge, Spennymoor (GB)

(73) Assignee: Black & Decker Inc., Newark, DE (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/139,371

(22) Filed: Aug. 25, 1998

(30) Foreign Application Priority Data

Aug. 30, 1997 (GB) ..... 9718336

(51) Int. Cl.[7] ..... B25B 45/00; B25B 45/02

(52) U.S. Cl. ..... 173/216; 173/29; 173/170; 173/217; 310/50; 408/20

(58) Field of Search ..... 173/216, 217, 173/29, 170; 408/20; 81/180.1, 54; 310/47, 50; 451/461

(56) References Cited

U.S. PATENT DOCUMENTS

| | | | | |
|---|---|---|---|---|
| 1,965,669 | | 7/1934 | Robb | 310/50 |
| 2,815,834 | * | 12/1957 | Mall | 173/170 |
| 2,884,902 | * | 5/1959 | Headings | 173/29 |
| 3,724,237 | * | 4/1973 | Wood | 173/29 |
| 3,759,336 | * | 9/1973 | Marcovitz et al. | 173/170 |
| 3,901,098 | * | 8/1975 | Jinkins | 173/216 |
| 4,030,383 | * | 6/1977 | Wagner | 81/180.1 |
| 5,033,552 | * | 7/1991 | Hu | 173/170 |
| 5,511,912 | * | 4/1996 | Ellerbrook | 408/20 |
| 5,624,000 | * | 4/1997 | Miller | 173/216 |
| 5,643,062 | * | 7/1997 | Joseph et al. | 451/461 |

* cited by examiner

*Primary Examiner*—Peter Vo
*Assistant Examiner*—Jim Calve
(74) *Attorney, Agent, or Firm*—Bruce S. Shapiro

(57) ABSTRACT

A power tool comprises a body (14) having a motor (22) with an output. A detachable tool head (50) is engageable with the motor output wherein the motor output has a first engagement member (32) for complimentary engagement with a second engagement member (62) on the tool head drive. The first engagement member (32) is recessed within the body (14) and accessible through an aperture (44) therein. And the second engagement member (62) is recessed within the tool head (52) and accessible through a second aperture therewithin.

20 Claims, 8 Drawing Sheets

POWER TOOL HAVING INTERCHANGEABLE TOOL HEAD

BACKGROUND OF THE INVENTION

1. Field of the Invention

The present invention relates to a power tool and, in particular, to a power tool having a conventional body portion and provided with a plurality of interchangeable tool heads.

2. Description of the Related Art

As a result of considerable developments within the field of power tools and the increased demand of the DIY market, the number of different types of power tool available to the consumer has risen considerably in the past decade. In particular even the most reluctant of DIY enthusiasts will own a power drill and jigsaw, whilst their more enthusiastic counterparts will also require electric sanders, power files, nibblers and other specialised power tools having dedicated purpose. Whilst this considerable array of power tools is often found to be useful, owning such a large number is both expensive and requires a considerable amount of storage space. In addition, having one specialised tool to perform each job often results in significant under-utilage of such a tool which are, generally, all operated by similar motors. Still further, many of todays power tools are "cordless", being battery powered by rechargeable batteries, often requiring the user to change the battery pack when changing dedicated tools, or have several ready-charged batteries available for different tools. These current solutions are cumbersome or expensive respectively.

Attempts have been made to improve utilage of such power tools and to provide solutions to the above problems by the inclusion of attachments for a conventional drill, whereby the drill chuck is used to engage a drive mechanism of a reciprocating saw blade, an example of which is seen in U.S. Pat. No. 1,808,228. Another example of a multi functional tool shown in German Gebrauchsmuster 9010138 which shows a conventional drill body having a plurality of drill heads which operate at different speeds dependent on the gear reduction mechanism incorporated in those heads. However, the drawbacks of systems of this type is that where a drill chuck is used to operate a drive mechanism for a reciprocating saw, considerable energy is lost in the conversion mechanism of firstly driving a drill chuck which then drives the saw mechanism. Alternatively, where the tool incorporates interchangeable drill heads the variety of functions are somewhat limited to altering the speed of drilling.

BRIEF SUMMARY OF THE INVENTION

It is therefore an object of the present invention to provide a power tool system which alleviates the aforementioned problems and allows for maximum utilage of that power tool.

According to the present invention there is provided a power tool system comprising a tool body having a motor with a direct rotary output and a detachable tool head, wherein the tool head comprises a drive mechanism for engagement with the motor output, said motor output comprising a first engagement means for complimentary engagement with a second engagement means on said head drive mechanism when said tool head is connected to said tool body, characterised in that said first engagement means is recessed within said body and accessible through an aperture in said body and said second engagement means is recessed within said tool head and accessible through a second aperture in said tool head.

Preferably, a tool wherein one of the tool head or the body is received through said aperture of the other of the tool head or body for the engagement means of said one of the other of said tool head or body to be received through the aperture of the one of the tool head or the body for said complimentary engagement to occur between the first and second engagement means within the one of the tool head or body.

Preferably, a tool in which the tool head has a spigot forming an internal chamber within which the second engagement means is recessed wherein said spigot and associated chamber are received within said body through said body aperture and said first engagement means is received within said tool head chamber.

Preferably, a tool in which first engagement means is housed within a substantially cylindrical chamber and the tool head has a substantially cylindrical spigot for a complimentary and co-axial fit within the cylindrical chamber of the body wherein both first and second engagement means are disposed on the axis of the cylindrical chamber and cylindrical spigot respectively to provide for automatic alignment of the first and second engagement means when said spigot is received within said cylindrical tool chamber.

It is preferred that a tool in which one of said first and second engagement means comprises a male cog and the other of said first and second engagement means comprises a female cog for receiving said male cog.

DESCRIPTION OF THE DRAWINGS

A preferred embodiment of the present invention will now be described by way of example only, with reference to the accompanying illustrative drawings in which.

DETAILED DESCRIPTION ON THE PREFERRED EMBODIMENT

Figure 1:
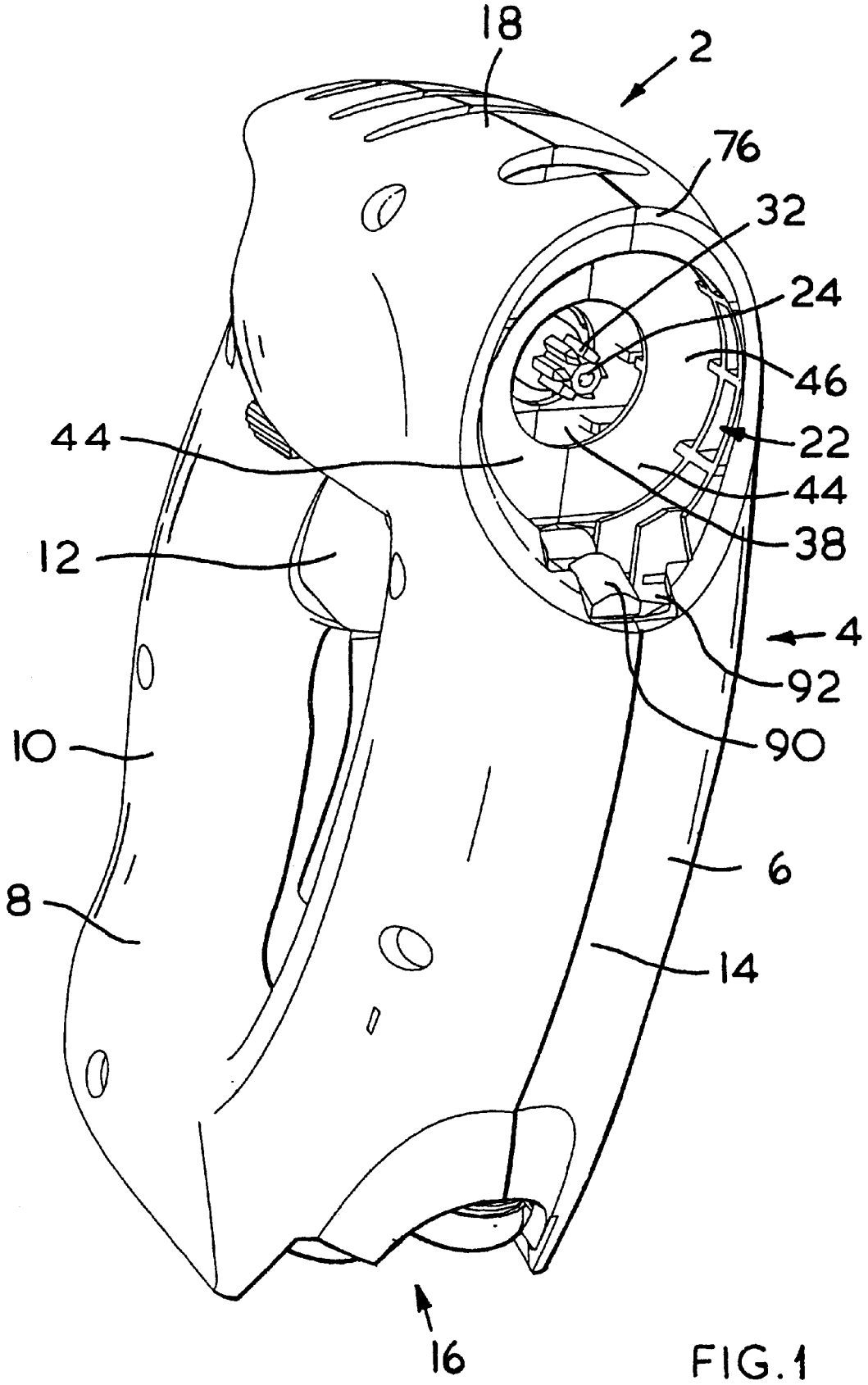
FIG. 1 shows a front perspective view of a body portion of a power tool in accordance with the present invention.

Referring now to FIG. 1, a power tool shown generally as (2) comprises a main body portion (4) conventionally formed from two halves of a plastic clamshell (6,8). The two halves are fitted together to encapsulate the internal mechanism of the power tool to be described later.

The body portion (4) defines a substantially D-shaped body, of which a rear portion (10) defines a conventional pistol grip to be grasped by the user. Projecting inwardly of this rear portion (10) is an actuating trigger (12) which may be operable by the users index finger in a manner conventional to the design of power tools. Such a pistol grip design is conventional and will not be described further in reference to this embodiment. The front portion (14) of the D-shape body serves a dual purpose in providing a guard for the users hand when gripping the pistol grip portion (10) and also serves to accommodate two batteries (26) (FIG. 5) to provide the power source for the tool (2). The two halves of the clamshell (6,8) define an opening shown generally as (16), which allows the batteries to be inserted within the tool. Such batteries are releasably restrained within the body portion by a conventional means and it will be appreciated to those skilled in the art that the inclusion of removable batteries (or battery packs) within power tools is well known and the mechanisms used to restrain and release such battery systems are also well known. As such, the batteries per se do not form part of the present invention and will not be described in further detail for this present invention.

The body portion (4) has an enlarged upper body section (18) extending between the front and rear portions (10, 14) which houses the power tool motor (20). Again, the motor (20) employed for this power tool is a conventional electric motor and will not be described in detail herein save for general functional description. This upper body section (18) further comprises a substantially cylindrical opening (22) defined by two halves of the clamshell (6,8) through which access to an output spindle (24) of the motor (20) is provided.

Figure 4:
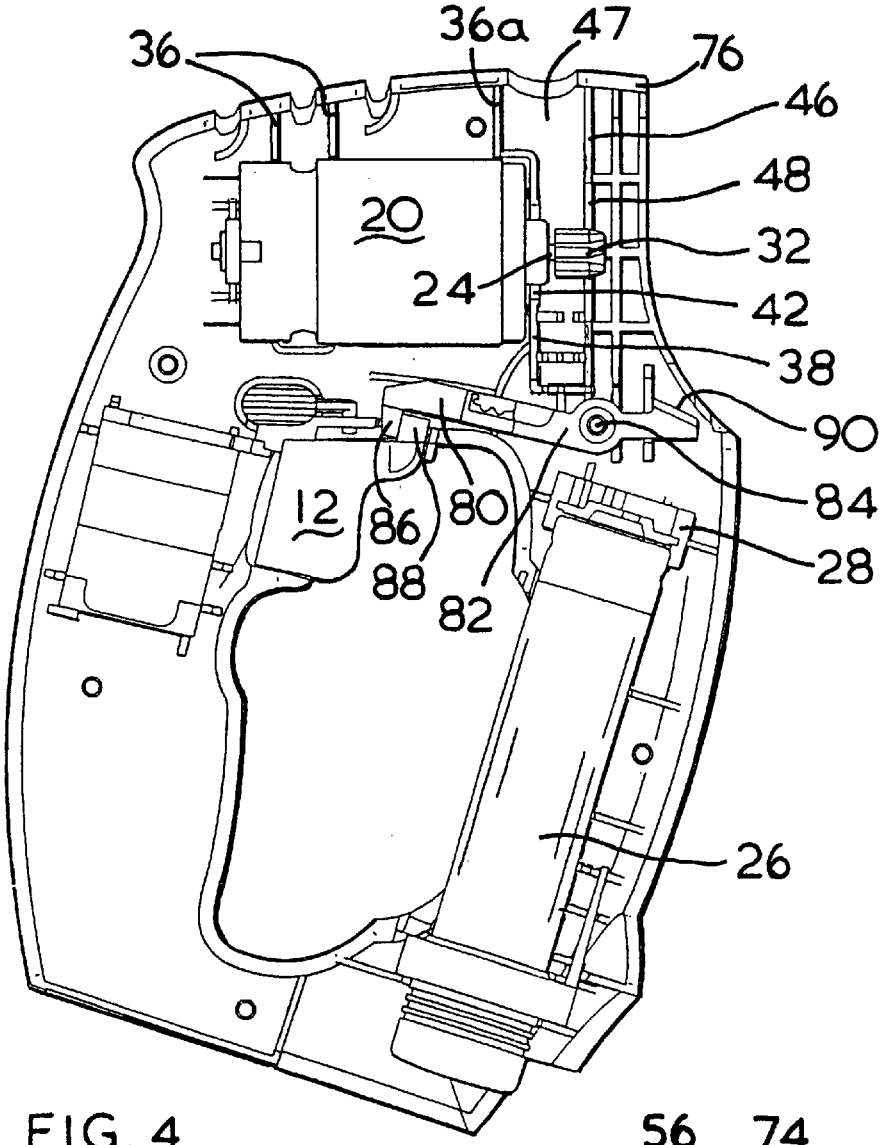
FIG. 4 shows the part cut away side elevation as shown in FIG. 3 with the tool head removed.
Figure 3:
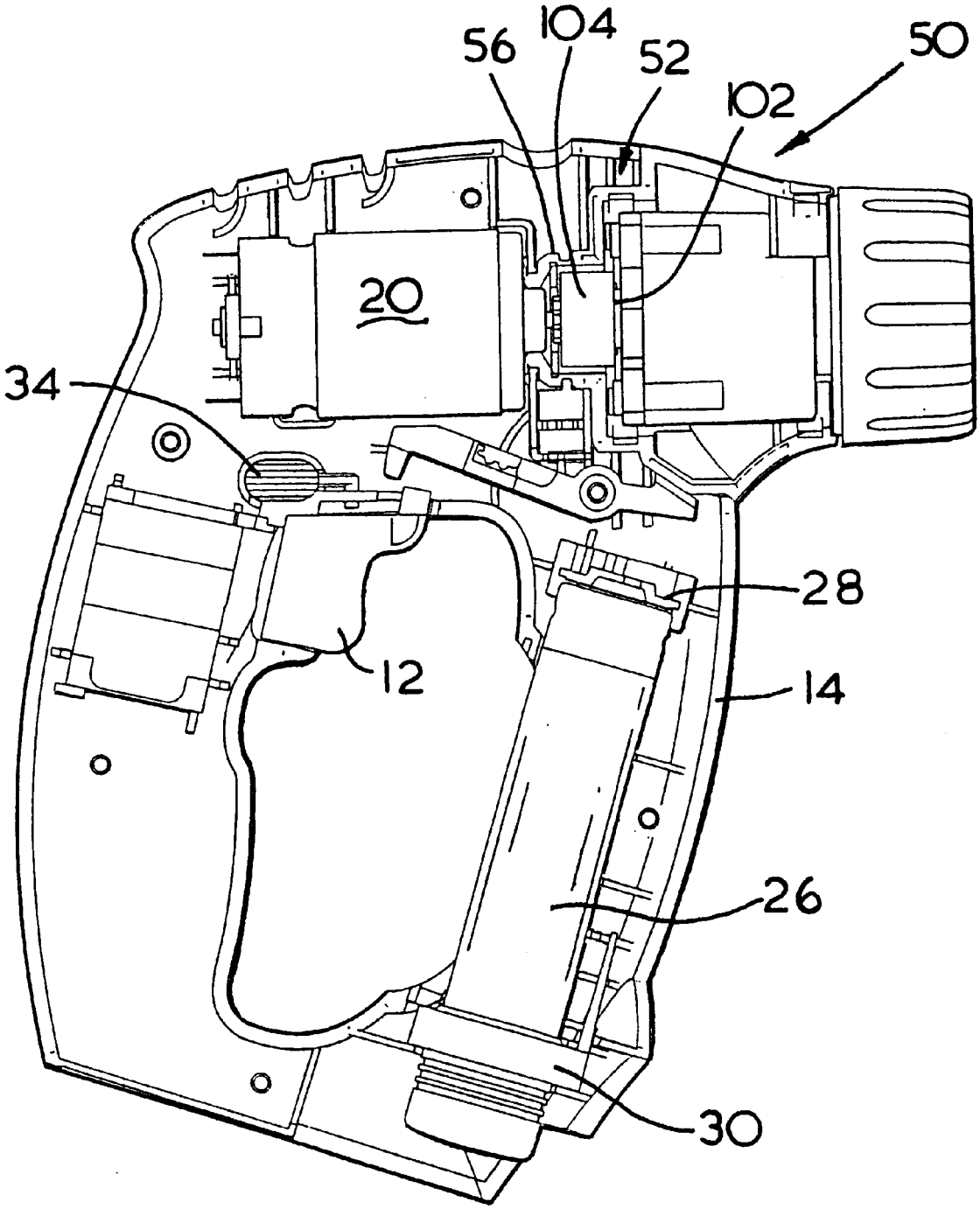
FIG. 3 shows a part cut-away side elevation of the body portion of FIG. 1 having a tool head attached thereto.
Figure 5:
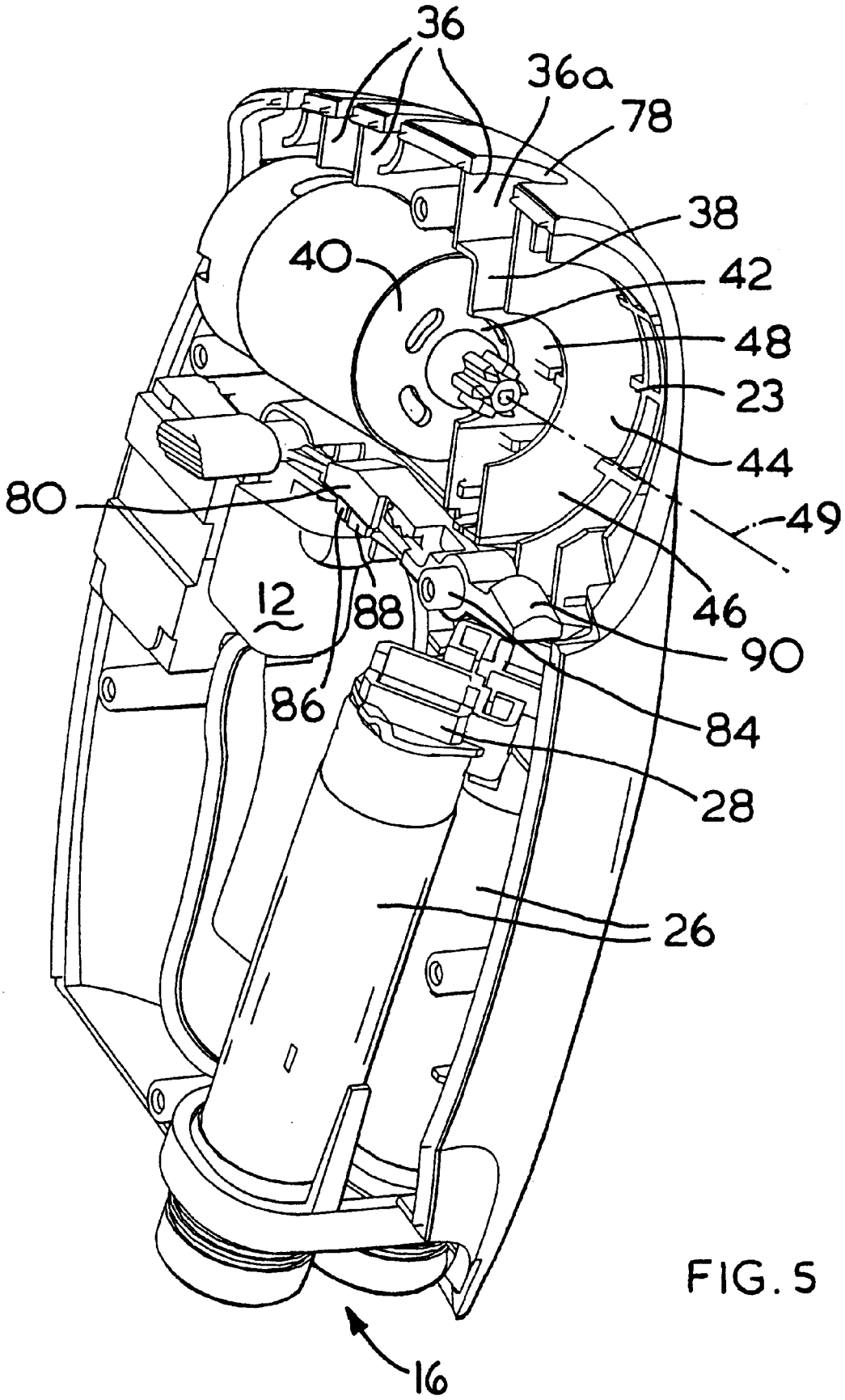
FIG. 5 is a perspective view of the body portion of FIG. 1 with half the clamshell removed.

Referring now to FIGS. 3, 4 and 5 the internal mechanism of the tool (2) will be described in more detail.

Two batteries (26) (only one of which is shown in FIGS. 3 and 4) are received through the battery opening (16) into the front portion (14) of the body (4) to electrically engage terminals (28). The batteries (26) are restrained within the tool body (4) by a detent mechanism (30) which is manually operable to facilitate removal of the batteries when so desired. Such a mechanism is conventional within the field of removable battery packs and will not be described further. The electrical terminals (28) are electrically coupled to the motor (20) via the trigger (12) in a conventional manner. (Note, for clarity in the drawings the electrical connections are not shown but comprise insulated wire connections of conventional design.) Upon actuation of the trigger (12) the user selectively couples the motor (20) to the batteries (26) thereby energising the motor (20) which in turn rotates an output spindle (24) to provide a high speed rotary output drive. As can be seen from FIGS. 1 and 4 the spindle (24) has a male cog (32) attachment for mesh engagement with a drive mechanism female cog on a power tool head which will be described hereinafter.

As is conventional for modem power tools, the motor (20) is provided with a forward/reverse switch (34) which, on operation, facilitates reversal of the terminal connections between the batteries (26) and the motor (20) (via switch 12) thereby reversing the direction of rotation of the motor output as desired by the user. Again such a mechanism is conventional within the field of power tools.

Referring now to FIG. 5, which shows the power tool (2) having one of the clamshells (8) removed to show, in perspective the internal workings of the tool, it will be seen that the motor is supported by conventional clamshell ribs (shown generally at (36) and which are mirrored by compatible ribs on the clamshell (8)) to restrain the motor within the clamshell. The foremost of these ribs (36*a*) (FIG. 4) forms a front extension plate (38) (FIG. 5) which (in conjunction with the comparable front extension plate on the removed clamshell portion (8)) substantially encloses the front of the motor (40) save for a circular aperture (42) through which the motor spindle (24) projects. The circular aperture (42) is co-axial with the motor spindle axis (49). The two clamshell halves (6,8) further comprise two semi-circular plates (44) disposed forward of the front extension plate (38) and substantially parallel therewith to form a second, outer extension plate (46) again having a circular aperture (48) to facilitate access to the motor spindle (24). Both apertures (42 and 48) are disposed co-axially on the axis (49). As can be seen from FIG. 4 the two extension plates (38, 46) serve to define a chamber (47) about the spindle axis (49), externally accessible through the aperture (48) and which substantially houses the spindle cog (32).

Furthermore, the outer extension plate (46) is itself recessed within the cylindrical opening (22) (thus forming a substantially cylindrical chamber between the opening (22) and the plate (46)) so that the spindle cog (32) does not project outwardly of the body portion (4).

The power tool (2) further comprises a plurality of interchangeable tool head attachments (one of which is shown generally as (50) in FIG. 3) which are attachable to the body portion (4) to form a particular type of power tool having a dedicated function. This aspect of the invention will be described hereinafter, but for initial reference the particular types of tool head will include, amongst others, a conventional drill chuck, a reciprocating saw drive mechanism and a detail sander. Each of the tool head attachments will have a drive mechanism for engagement with the spindle cog (32) so that the motor (20) will drive the drive mechanism of each tool head.

Figure 2:
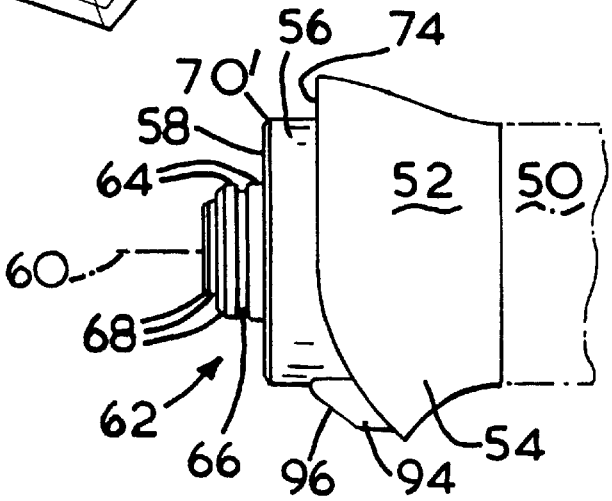
FIG. 2 shows a part side elevation of a tool head attachment mechanism.

Referring now to FIG. 2, each of the tool head attachments (referred to on (50)) have a uniform connection system (52) shown in FIG. 2 in solid lines. This tool head connection system (52) comprises a substantially cylindrical outer body portion (54) which is ergonomically designed to match the exterior contours of the body portion (4) when the attachment is connected thereto. This outer body portion (54) design will vary for different types of tool head attachments (as will be seen later) and generally serves to provide a different profile to the power tool dependent on its particular function. The design shown in FIG. 2 is that intended for use with a drill chuck head attachment.

Extended rearwardly of this outer body portion (54) is a substantially cylindrical spigot (56) which is shaped so as to fit snugly within the cylindrical opening (22) of the body portion (4). As seen in FIG. 5, the cylindrical opening (22) of the body portion is defined by a series of inwardly directed ribs (23) forming a substantially cylindrical chamber. This cylindrical spigot (56) has a substantially flat circular rear wall (58) disposed about a head axis (60). Projecting rearwardly of this wall (58) so as to extend co-axially with the axis (60) is a second, substantially cylindrical and hollow spigot (62) having a diameter substantially less than the diameter of the spigot (56). This hollow spigot (62) has a series of exterior cylindrical ribs (64) which define an outer cylindrical recess (66). In addition, the spigot (62) has a gradually increasing exterior diameter formed by a series of chamfered steps shown generally at (68) inclined radially outward from the axis (60) in a direction from left to right as viewed in FIG. 2. These chamfered steps (68) provide inclined lead-in shoulders on the spigot (62) to form a generally tapered spigot. In addition, the spigot (56) also has a chamfered step (70) again forming an inclined lead-in cam surface.

Thus, as the tool attachment (50) is brought into engagement with the body portion (4) the connection system (52) is inserted into the cylindrical opening (22) of the body portion (4) for the tool attachment axis (60) to extend substantially co-axially with the spindle axis (49). As the connection system (52) passes into the cylindrical opening (22) the chamfered leading edge (70) may abut the ribs (23) so as to maintain the head attachment (50) co-axial with the spindle axis (49). As such, the lead-in edge (70) serves as a guide surface. Further insertion of the connection system (52) into the opening (22) will cause the hollow cylindrical spigot (62) to pass through the aperture (48) in the outer extension plate (46) so as to encompass the spindle cog (32).

As can be seen from FIG. 3 the inner aperture (42) of the front extension plate (38) has a smaller diameter than the aperture (48) of the outer extension plate (46). Furthermore, the remote end (72) of the spigot (62) has a diameter corresponding substantially to the diameter of the aperture (42) whereas the inner diameter of the spigot (62) has a diameter corresponding to the diameter of the aperture (48). In this manner, as the tapered spigot (62) is inserted into the body portion (4) the spigot (62) will be received in a complimentary fit within the apertures (42 and 48) as shown in FIG. 3. In this manner the front extension plate (38) and outer extension plate (46) serve to firmly receive the spigot of the connection system (52) to restrain the connection system from axial displacement within the power tool body portion (4). Furthermore, this axial support of the connection system is assisted by the snug fit of the spigot (56) within the cylindrical opening (22). A shoulder portion (74) formed between the outer body portion (54) and the spigot (56) serves to restrain the connection system from further displacement of the connection system axially by its abutment against the outer rim (76) of the clamshell, as shown in FIG. 3.

To restrain the tool attachment (50) in connection with the body portion (4), the body portion (4) is further provided with a resiliently biased locking mechanism within the chamber (47) (defined between the front extension plate (38) and outer extension plate (46) (FIG. 4)). This locking means (which is not shown in the attached drawings) comprises a resilient mechanism comprising two resiliently biased spring wires and disposed symmetrically about the axis (60) which extend across the apertures (42 and 48) so that as the connection system (52) passes through the aperture (48) the chamfered steps (68) of the spigot (62) will engage the biased wires and deflect them out of the path of the cylindrical spigot (56). Further insertion of the spigot (62) into the body portion (4) will then enable these resiliently deflected wires to encounter the cylindrical recess (66) on the spigot (56) and, by returning to the resiliently biased position snap engage with this recess (66) to restrain the connection system (52) from further axially displacement. In addition this locking mechanism is provided with a conventional push button (not shown) which extends through an aperture (78) in the body (4) whereby actuation of this push button will cause the two wires to be pushed apart so that they are moved out of engagement with the cylindrical recess (66) in the connection system (52) to thereby release the tool attachment head (50) when required.

The power tool (2) is further provided with an intelligent lock-off mechanism (FIGS. 4, 5 and 6) which is intended to prevent actuation of the actuating trigger (12) when there is no tool head attachment (50) connected to the body portion (4). Such a lock-off mechanism serves a dual purpose of preventing the power tool from being switched on accidentally and thus draining the power source (batteries) whilst it also serves as a safety feature to prevent the power tool being switched on when there is no tool head attached which would present a high speed rotation of the spindle cog (32) (at speeds approaching 15,000 rpm) which could cause serious injury if accidentally touched.

The lock-off mechanism (80) comprises a pivoted lever switch member (82) pivotally mounted about a pin (84) which is moulded integrally with the clamshell (6). The switch member (82) is substantially a elongate plastics pin having at its innermost end a downwardly directed projection (86) which is biased (by a conventional helical spring, not shown) in a downwards direction to the position as shown in FIG. 4 so as to abut the actuating trigger (12). The actuating trigger (12) comprises an upstanding projection (88) presenting a rearwardly directed shoulder which engages the pivot pin projection (86) when the lock-off mechanism (80) is in the unactuated position (FIG. 4).

In order to operate the actuating trigger (12) it is necessary for the user to depress the trigger (12) with their index finger so as to displace the trigger switch (12) from right to left as viewed in FIG. 4. However, the abutment of the trigger projection (88) against the projection (86) of the lock-off mechanism restrains the trigger switch (12) from displacement in this manner.

The opposite end of the switch member (82) has an outwardly directed cam surface (90) being inclined to form a substantially wedge shaped profile as seen in FIG. 4.

Referring now to FIG. 1 it is seen that the two halves of the clamshell (6 and 8) in the region of the cylindrical opening (22) form a substantially rectangular channel (92) (in cross-section) extending downwardly from the periphery of this cylindrical opening (22) and which is shown generally as (92). The cam surface (90) is received within this channel (92) so as to be presented outwardly of the body portion (4) (FIG. 1).

Referring now to FIG. 2 the tool attachment (50) has an additional projection (94) which is substantially rectangular in cross-section and presents an inclined cam surface (96) which is inclined radially outwardly from the axis (60) in a direction away from the spigot (62). This projection (94) has a cross-sectional profile compatible with the rectangular channel (92) of the body (4) and is designed to be received therein. This projection (94) thus serves a dual purpose (i) as an orientation mechanism requiring the tool head to be correctly orientated about its axis (60) relative to the body portion (4) in order that this projection (94) is received within the rectangular channel (92) (which thus serves to position the tool head in a pre-determined alignment relative to the body portion) whilst (ii) the cam surface (96) serves to engage the cam surface (90) of the lock-off mechanism (80) so that continued displacement of the tool attachment (50) towards the body portion (4) causes cam engagement between the cam surfaces (96 and 90). This cam engagement causes pivotal deflection of the switch member (82) about the pin (84), (against the resilient biasing of the helical spring (not shown)) and to thus move the projection (86) in an upwards direction (to the actuated position as shown in FIG. 3), thus moving this projection (86) out of engagement with the trigger projection (88) which thus allows the actuating trigger (12) to be displaced as required by the user to switch the power tool on as required. This attachment of the tool head automatically de-activates the lock-off mechanism.

Furthermore, an additional feature of the lock-off mechanism results from the requirement, for safety purposes, for certain tool head attachments (in particular that of a reciprocating saw) to form power tools which necessitate a manual, and not automatic, de-activation of the lock-off mechanism. Whereas it is acceptable for a power tool such as a drill or a detailed sander to have a actuating trigger switch (12) which may be depressed when the tool head is attached without any safety lock-off switch, the same is generally unacceptable for tools such as a reciprocating saw whereby accidental activation of a reciprocating saw power tool could result in serious injury if the user is not prepared. For this reason reciprocating saws, and jigsaws and other dangerous power tools, are required to have a manually operable switch to de-activate any lock-off mechanism on the actuating trigger (12). Therefore, when the tool attachment (50) comprises a reciprocating saw head the projection (94) as shown in FIG. 2 remains substantially hollow with a front opening to pass over the cam surface (90) so that no cam surface (96) is presented by such a tool head attachment. In such a situation as the tool head attachment (50) is connected to the body portion (4) as previously described the projection (94) serves to orientate the tool head in the correct orientation relative to the tool body by being received within the channel (92), but such projection (94) is simply received over the switch member cam surface (90) so that this switch member is not actuated, thus leaving the lock-off mechanism in engagement with the trigger switch to prevent accidental activation of this trigger (12).

The reciprocating saw tool head is then provided with a manually operable switch member (not shown) which comprises a cam surface (similar to cam surface (96) as previously described) compatible with the cam surface (90). Operation of this switch member services to displace the compatible cam surface through the projection (94), into engagement with the cam surface (90) when the tool head is attached to the body portion (4) serving to pivotally displace the lock-off mechanism (80) in a manner previously described, so as to release the trigger switch (12). This manually operable switch will be resiliently biased away from the body portion (4) so that once it has been used to de-activate the lock-off mechanism and the trigger switch (12) displaced so as to activate the power tool, the manually operable switch is released and thus disengages the cam surface (90) whereby the downwardly directed projection (86) of the switch member (82) would then biased towards engagement with the trigger projection (88). However, at this time since the trigger switch (12) will have been displaced from right to left as shown in FIG. 3, the projection (86) will abut an upper surface of the trigger projection (88) while the tool is in use. When the user has finished use of the tool the trigger (12) will be released (and moved from left to right under conventional spring biasing means common to the art) which will then allow the downwardly biased projection (86) to re-engage the shoulder of the trigger projection (88) to restrain the actuating trigger from further activation as previously described. Therefore, if the user wishes to again activate the tool with the reciprocating saw tool head he must manually displace the switch on the tool head so as to de-activate the lock-off mechanism as previously described. This provides the safety feature that when a saw head attachment is connected to the body portion (4) the actuating trigger (12) may not be accidentally switched on. This provides tool heads with automatic or manually operable means for de-activating the lock-off mechanism, i.e. an intelligent lock-off mechanism which is able to identify different tool head functions, and is able to identify situations whereby manual de-activation of the lock-off mechanism is required.

Referring now to FIG. 3, each of the tool head attachments (50) will have a drive spindle (102) to which is coupled, at its free end, a female cog member (104) which is designed to engaged with the male cog (32) from the motor output spindle (24) (FIG. 4). It will be appreciated that when the male and female cogs of the motor spindle (24) and the drive spindle (102) mate together when the tool head attachment (50) is connected to the body (4), then actuation of the motor (20) will cause simultaneous rotation of the head drive spindle (102) therefore providing a rotary drive to the tool head drive mechanism (to be described later).

As can be seen from FIG. 3, which includes a side elevation of a tool head (50) (in this example a drill chuck) it is clearly seen that the female cog member (104) is wholly enclosed within the cylindrical spigot (56) of the connection system (52). As previously described this cylindrical spigot (56) has a cylindrical end opening to receive the male cog (32) of the motor spindle (24) (as seen in FIG. 3). In addition as can be seen from FIGS. 1 and 4 the male cog (32) is recessed within the tool body (4) and is accessible only through the cylindrical opening (22) and the aperture (48). In this manner both of the male and female cogs have severely restricted access to alleviate damage to these potentially delicate parts of the connection mechanism. In particular the male cog (32) is directly attached to the motor spindle and a severe blow to this spindle could damage the motor itself whereby recessing the cog (32) within the tool body (4) the cog itself is protected from receiving any direct blows, for example if the tool body was dropped without a head attachment. Furthermore, by recessing this cog within the tool body (and in the situation whereby the lock-off mechanism was deliberately de-activated—for example by use of a member pushed against the cam surface (90)) then even if the motor was able to be activated, the high speed rotation of the cog (24) would not be easily accessible to the user who would thus be protected from potential injury. Thus, by recessing the male and female cogs within the clamshells of the body and the head respectively these delicate parts are protected from external damage which may occur in the work environments in which they are used.

Still further, by positioning the female cog (104) within the cylindrical spindle (56) it is automatically aligned substantially with the axis (60) of the tool head (50) which is then automatically aligned with the axis (49) of the motor spindle (24) by virtue of the alignment of the spigot (56) within the aperture (48) so that male and female cog alignment is substantially automatic upon alignment of the tool head with the tool body.

Figure 6:
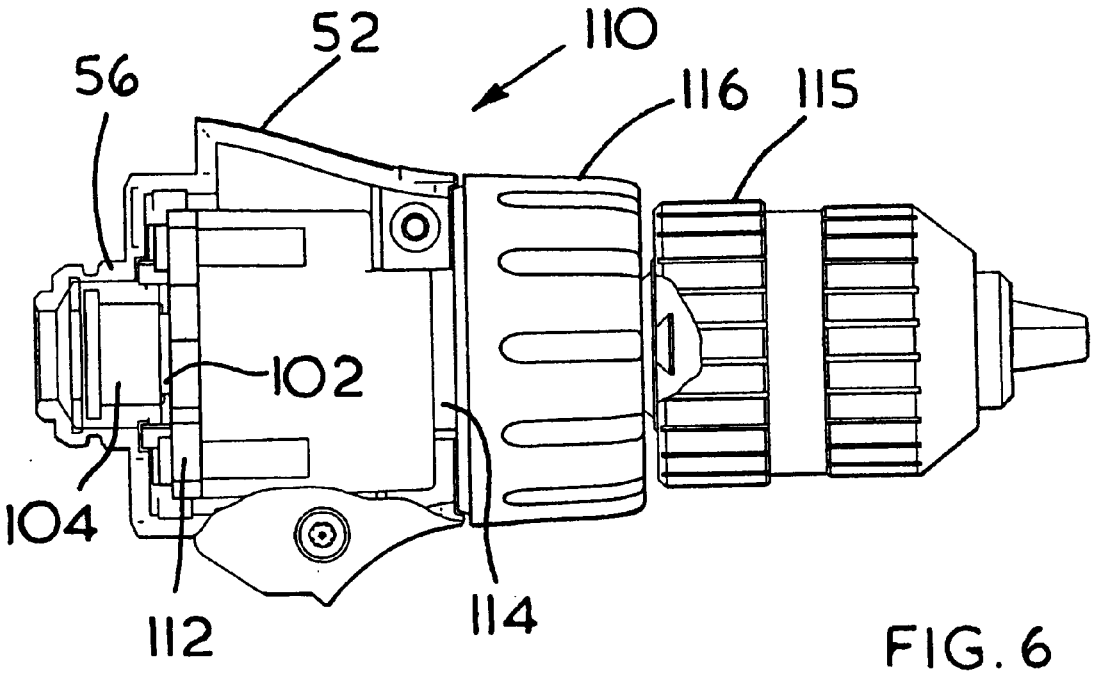
FIG. 6 is a side elevation of a drill chuck tool head with part clamshell removed.
Figure 7:
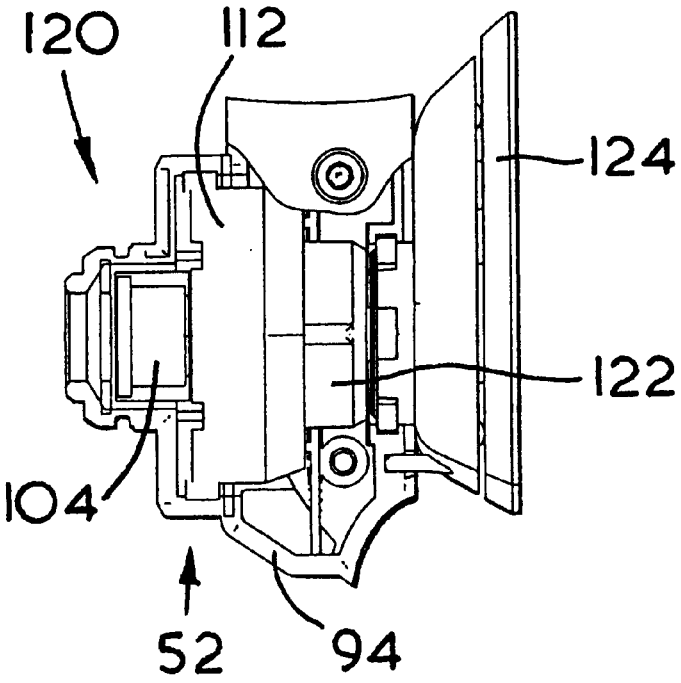
FIG. 7 is a side elevation of a detailed sander tool head with part clamshell removed.
Figure 8A:
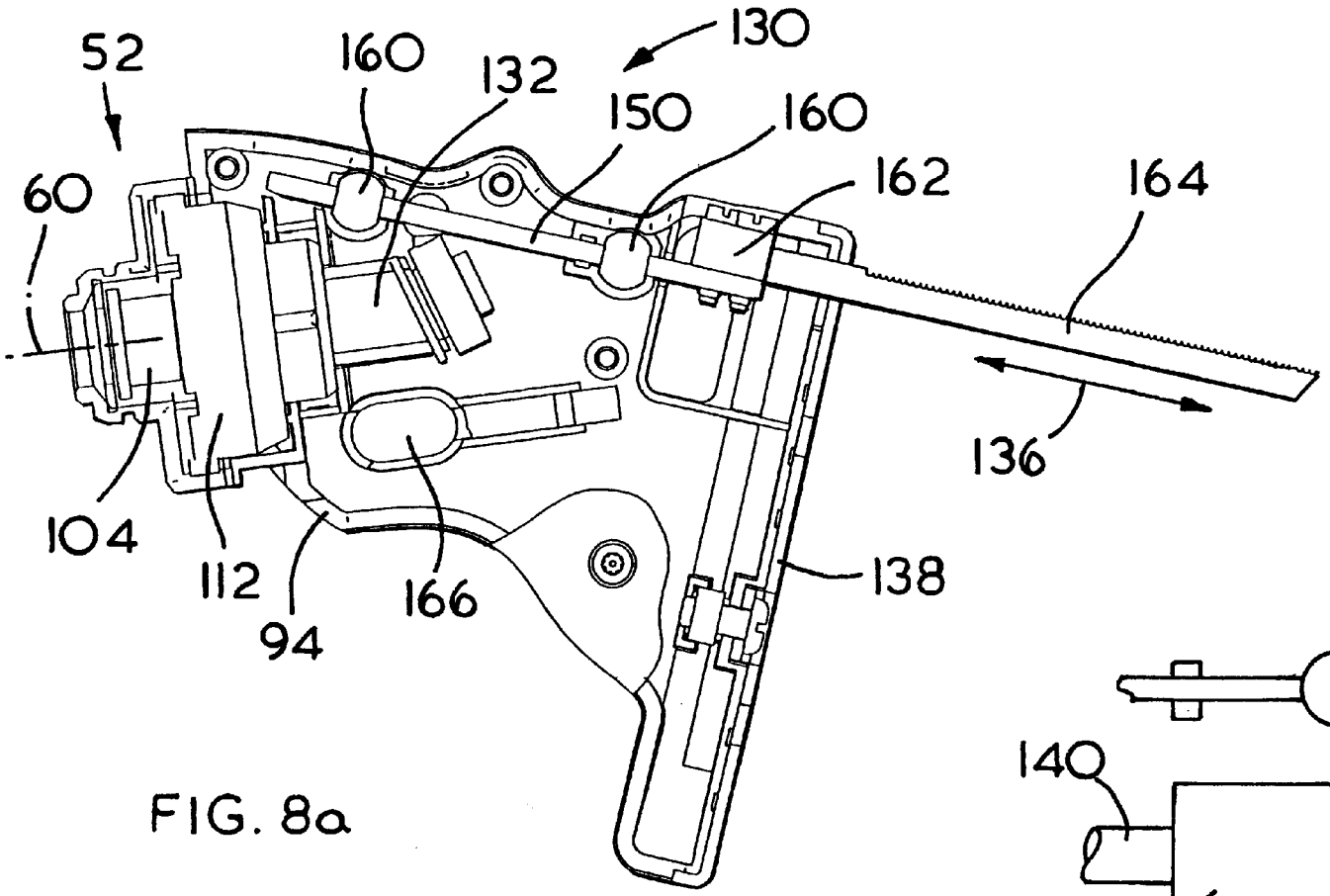
FIG. 8*a* is a side view of a reciprocating saw tool head with part clamshell removed.
Figure 8B:
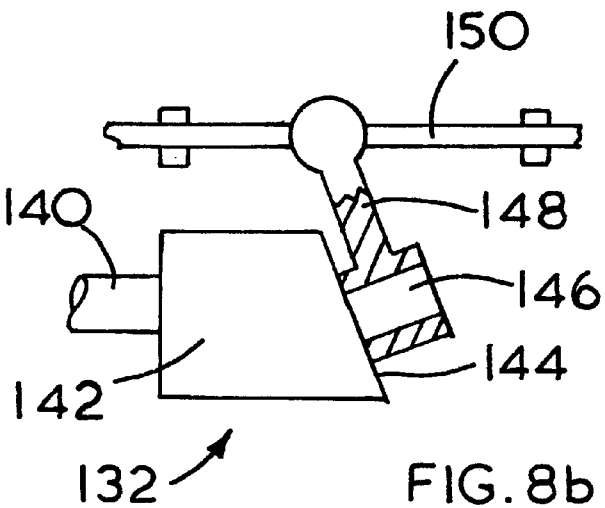
FIG. 8*b* is a schematic view of the drive conversion mechanism of the reciprocating saw tool head of FIG. 8*a;*

Referring now to FIGS. 6, 7 and 8, three specific tool head attachments are shown. FIG. 6 shows a drill tool head attachment (corresponding to that shown in FIG. 3 generally at (50)) with the clamshell portion of the connection system (52) half removed to show, schematically, the drive mechanism of this drill tool head. As previously described, this drill tool head has a connection system (52) having a cylindrical spigot (56) which connects with the tool body (4) as previously described. Housed within the spigot (56) is the head drive spindle (102) having connected thereon a female cog member (104) for engagement with the male cog (32) connected to the motor spindle (24). The drive spindle (102) has an inner drive cog (not shown) which is designed to drive a conventional sun and planet gear reduction mechanism illustrated generally as (112). To those skilled in the art, the use of a sun and planetary gear reduction mechanism is standard practice and will not be described in detail here save to explain that the motor output generally employed in such power tools will have an output of approximately 15,000 rpm whereby the gear and planetary reduction mechanism will reduce the rotational speed of the drive mechanism to that required for this specific tool function. In the particular case of a conventional drill this first gear reduction mechanism will have an output of approximately 3,000 rpm, which is then used as an input drive to a second sun and planet gear reduction mechanism to provide a final rotary output of approximately 800 rpm. The exact ratio of gear reduction will be dependent on the number of teeth on the cogs employed in the gear arrangement. The output drive (114) of this gear reduction mechanism (112) then drives a conventional drill chuck (115) in a manner conventional to those skilled in the art. In the particular drill head shown as (110) a clutch mechanism shown generally as (116) (which is again conventional for electric drills and will not be described in any detail here) is disposed between the gear reduction mechanism and the drill chuck. When this drill head attachment is connected to the tool body the power tool (2) acts as a conventional electric drill with the motor output drive driving the gear reduction mechanism via the male/female cog connection (32, 104).

Referring now to FIG. 7, which shows a detail sander tool head (120) one half of the clamshell is removed to allow the drive mechanism is to be shown schematically. This tool head (120) has the connection system (52) as previously described together with the cam projection (94) required for de-activation of the lock-off mechanism as previously described. However, it will be noted here that the outer peripheral design of this tool head varies to the drill tool head (110) but is again designed to be flush fit with the body portion (4) so as to present a comfortable ergonomic design for a detailed sander once this head is connected to the body. To this end, each of the tool head clamshell designs ensures that once that tool head is connected to the tool body, then the overall shape of the power tool is ergonomically favourable to the function of that power tool to allow the tool to be used to its maximum efficiency.

Again, the detailed sander tool head (120) has a drive shaft with female cog member (104) which again is connected to a conventional gear reduction mechanism (112) (conventional sun and planet gear reduction mechanism) to provide a rotary output speed of approximately 3,000 rpm. The gear reduction output (122) is then employed to drive a conventional eccentrically driven plate on which the detailed sander platen (124) is mounted. The gear reduction and drive mechanism of the tool head (120) is conventional to that employed in a detail sander having an eccentrically driven platen. As such, this drive mechanism will not be described herein in any detail since it is commonplace in the art.

FIG. 8 shows a reciprocating saw tool head attachment (130) having the conventional connection system (52) connection with the tool body (4). Again the tool connection system (52) will house the drive spindle (102) with female cog member (104) connected to a gear reduction mechanism (112) to reduce the speed of the head drive mechanism to approximately 3,000 rpm. The gear reduction mechanism (112) then has a rotary output connected to a drive conversion mechanism shown generally at (132) which is used to convert the rotary output of the gear reduction mechanism to linear motion to drive the saw blade (134) in a linear reciprocating motion indicated generally by the arrow (136). Whilst is can be seen from FIG. 8 that this reciprocating motion is not parallel with the axis of the tool head, this is merely a preference for the ergonomic design of this particular tool head (130) although, if necessary, the reciprocating motion could be made parallel with the tool head (and subsequently motor drive) axis (60). The tool head (130) itself is a conventional design for a reciprocating or pad saw having a base plate (138) which is brought into contact with the surface to be cut to stabilise the tool (if required) and again the exterior shape of this tool head has been chosen for ergonomic preference.

The drive conversion mechanism (132) utilises a conventional reciprocating space crank illustrated, for clarity, schematically in FIG. 8*a*. The drive conversion mechanism (132) will have a rotary input (140) (which for this particular tool head will be the gear reduction mechanism output at a speed of approximately 3,000 rpm and which is co-axial with the axis of rotation of the motor of the tool itself). The rotary input (140) is connected to a link plate (142) having an inclined front face (144) (inclined relative to the axis of rotation of the input). Mounted to project proud of the surface (144) is a tubular pin (146) which is caused to wobble in reference to the axis of rotation of the input (140). Freely mounted on this pin (146) is a link member (148) which is free to rotate about the pin (146). However, this link member (148) is restrained from rotation about the drive axis (140) by engagement with a slot within a plate member (150). This plate member (150) is free (in the embodiment of FIG. 8*a*) to move only in a direction parallel with the axis of rotation of the input (140). Thus, the wobble of the pin (146) is translated to linear reciprocating motion of the plate (150) via the link member (148). This particular mechanism for converting rotary to linear motion is conventional and has only been shown schematically for clarification of the mechanism (132) employed in this particular saw head attachment (130).

In the saw head (130) the plate (150) is provided for reciprocating linear motion between the two restraining members (160) and has attached at a free end thereof a blade locking mechanism (162) for engaging a conventional saw blade (164) in standard manner. Thus the tool head (130) employs both a gear reduction mechanism and a drive conversion mechanism for converting the rotary output of the motor to a linear reciprocating motion of the blade.

Furthermore, the reciprocating saw tool head (130) has a projection (94) for orientating the tool head (130) relative to the body of the power tool (4). However, as previously described, this projection (94) (for this particular tool head) is hollow so as not to engage the cam surface (90) of the lock-off mechanism (80). This tool head is then provided with an additional manually operable button (166) which, on operation by the user, will enable a spring biased member (not shown) to pass through the hollow projection (94) when the head (130) is attached to the body (4) so as to engage the cam surface (90) of the lock-off mechanism (80) to manually de-activate the lock-off mechanism when power is required to drive the reciprocating saw (as previously described).

Although three specific tool head embodiments have been shown in FIGS. 6, 7 and 8, the present invention is by no means limited to three such tool heads. In particular, a complete range of tool head attachments may be connected to the body to obtain a functional tool which is currently available as an existing single function power tool. Two more examples of tool head attachments will now be shown, schematically only, in FIGS. 9 and 10 in conjunction with an alternative embodiment of the power tool showing a much simplified body portion design.

Figure 9:
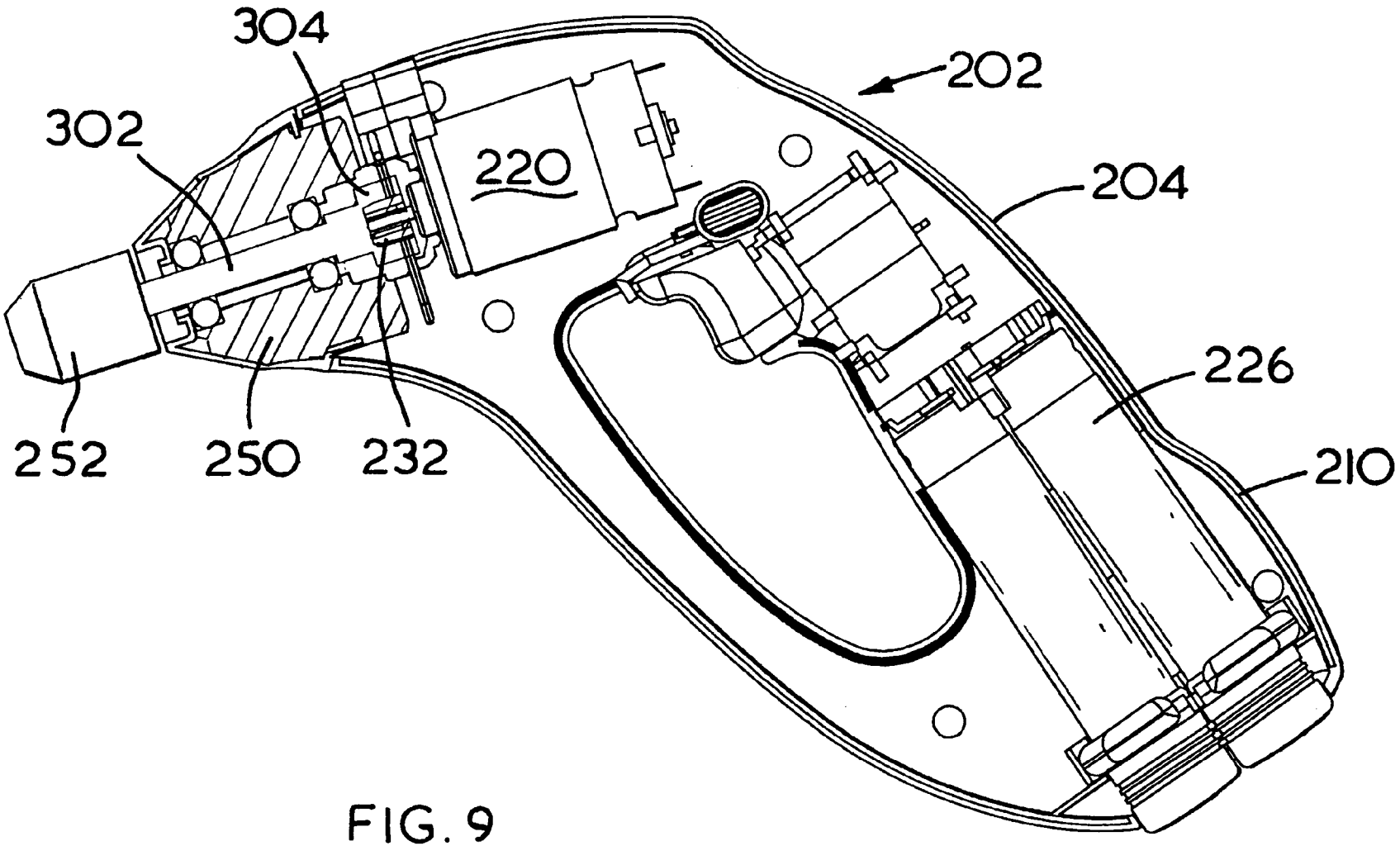
FIG. 9 is a side view an alternative embodiment of a power tool with high speed rotary tool head attachment with half clamshell removed.

Referring now to FIG. 9 the power tool (202) again has a substantially D-shaped body portion (204) similar to that described in reference to FIGS. 1 through to 5. However, in the power tool (202) the batteries (226) are releaseably received within the rear portion (210) of the body (204). However, the basic internal working mechanism of the body (204) corresponds to that of the body (4) of FIGS. 1 through 5 and will not be described further. Furthermore, for this simplified embodiment, there is no lock-off mechanism shown and the attachment mechanism of the head to the tool body has been substantially simplified and is merely shown schematically. However, FIG. 9 shows a tool head attachment (250) comprising a high speed rotary tool having a conventional drill chuck (252) directly driven by the motor output at a speed of approximately 15,000 rpm without any gear reduction. Such high speed tools are commonly used by craftsmen for polishing, grinding, etching etc. Here the motor (220) again has a male cog attached to the motor spindle which is received within a female cog (304) of the tool head in a similar manner to that previously described. However, for this tool head design the female cog (304) is attached to the head drive spindle (302) which does not undergo any gear reduction but is used to directly drive the tool chuck (252). It will be appreciated that this drive mechanism may be incorporated into the tool head design as shown in FIG. 6 to incorporate the connection system (52).

Figure 10A:
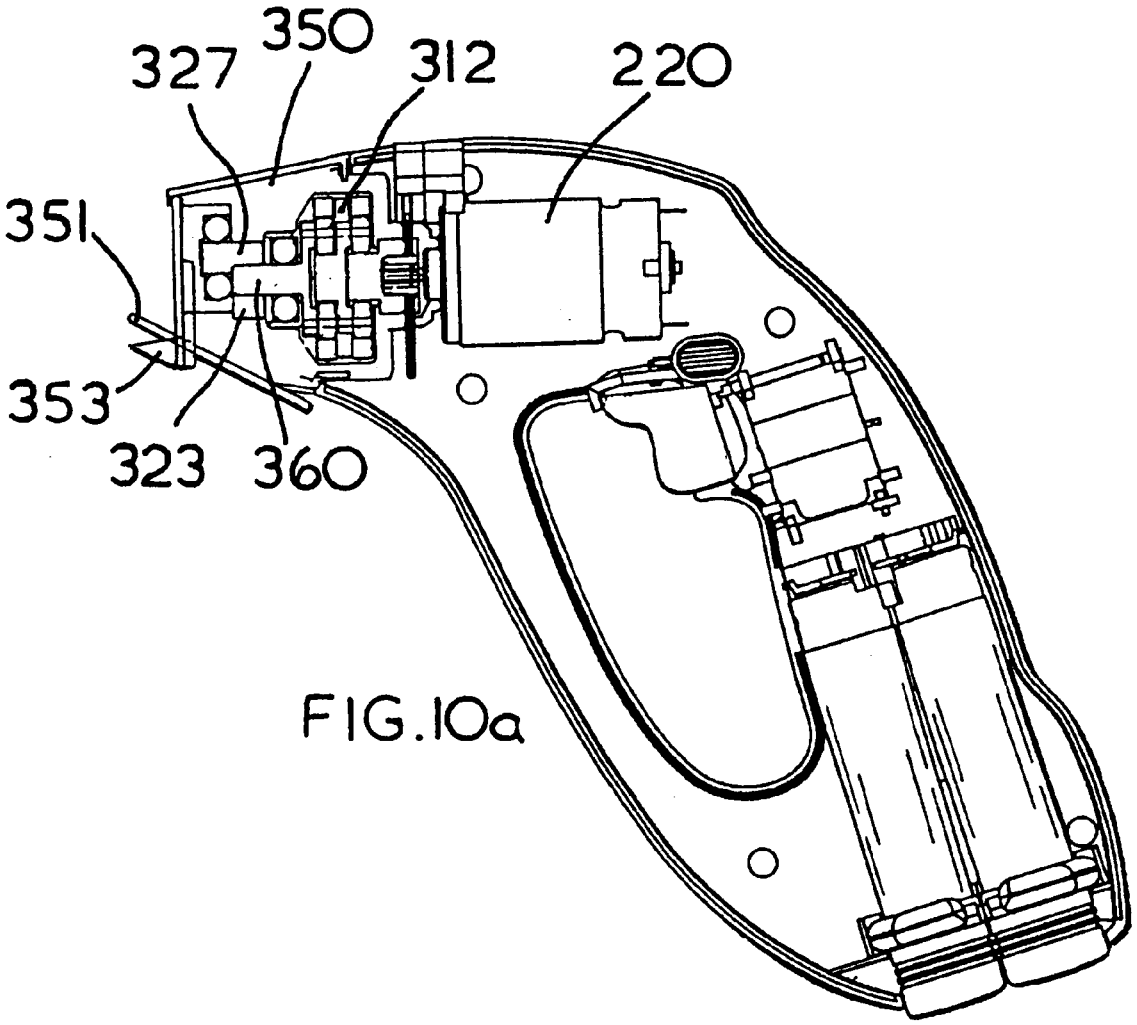
FIG. 10*a* is an alternative embodiment of the power tool of FIG. 9 with a nibbler tool head attachment with half clamshell removed.

Still further, FIG. 10*a* shows the alternative schematic embodiment shown in FIG. 9 but having a different tool head attachment (350) in the form of a nibbler. A nibbler is a cutting tool specifically designed for cutting plastics material and linoleum and comprises a fixed cutting plate (351) rigidly attached to the tool head (350) and a cutting blade (353) which is driven by the drive mechanism of the head (350) in a vertical (linear) reciprocating motion so as to form a scissors action with the plate (351). Again in this embodiment (shown schematically) the motor (20) is connected via male and female cogs (as previously described) to the tool head drive mechanism which undergoes a dual gear reduction mechanism shown generally as (312) which employs a double gear reduction mechanism i.e. the rotary input to the tool head is passed to a conventional sun and planet gear reduction mechanism to provide a rotary output having a speed of approximately 3,000 rpm with this output then driving a second planet, sun gear reduction mechanism to provide a final output speed of approximately 800 rpm. Output of this second gear reduction mechanism then drives a conventional drive conversion mechanism for converting the rotary output to a linear reciprocating motion to operate the blade (353). This gear conversion mechanism is shown generally as (323) and will be briefly described with reference to FIG. 10*b*.

Figure 10B:
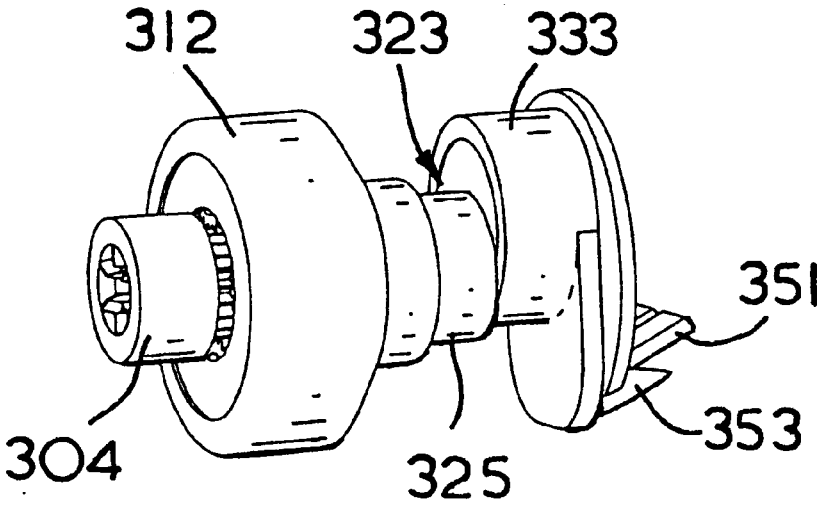
FIG. 10*b* is the drive mechanism of the nibbler tool head attachment of FIG. 10*a*.

FIG. 10*b* shows schematically the gear reduction and drive conversion mechanism of the nibbler head attachment (350) wherein the female cog member (304) is rotated by the motor output via the male cog member attached to the motor (220). This rotary motion is then passed through the gear reduction mechanism (312) to provide a rotary output (360) (FIG. 10*a*). This rotary output (360) then drives a rotary disc (325) having an eccentric pin member (327) (FIG. 10*a*) which is slidably received within a horizontal slot within the plate member (333). This plate member (333) is restrained by the casing of the head attachment (350) from rotary motion, thus as the pin (327) describes its rotary path, the pin will move freely in a horizontal motion within the plate (333) whilst the vertical displacement of the pin (327) is directly translated to vertical displacement in an oscillating motion of the plate member (333) which in turn provides a reciprocating vertical (linear) movement of the cutting blade (353). Again this is a conventional drive conversion mechanism for converting rotary to linear motion and is well documented in an engineering text book.

It will be appreciated by those skilled in the art that the particular embodiments of the tool head attachment described herein are by way of example only and merely serve to describe tool head attachments which employ (i) no gear reduction or drive conversion mechanisms, (ii) those which have simple gear reduction mechanisms and (iii) those which have both gear reduction and drive conversion mechanism for converting the rotary to non rotary output. Thus, a power tool system is provided which provides for a plurality of power tool functions having different output functions, all driven by a single speed motor.

Furthermore, it will be appreciated that the drive conversion mechanisms described with reference to the tool heads described herein are conventional and provided by way of example only. It will be appreciated that any conventional drive conversion mechanism for converting rotary to linear reciprocating motion may be used in place of those systems described herein. Furthermore, alternative gear reduction mechanisms may be utilised to replace the conventional sun and planet gear reduction mechanisms referred to for these particular embodiments.

In addition, whilst the specific embodiments of the tool have referred to the power source as batteries, and such batteries may be conventional or rechargeable, it will also be appreciated that the present invention will relate to a power tool having a conventional mains input or for use with alternative heavy duty battery packs.

What is claimed is:

1. A power tool comprising:

a tool body having a motor with a motor output; and a detachable tool head, the tool head including a drive mechanism for engagement with the motor output;

said motor output including a first engagement means for complimentary engagement with a second engagement means on said head drive mechanism when said tool head is connected to said tool body, said first engagement means completely recessed within a non-removable portion of said body and accessible through an aperture in said body and said second engagement means is completely recessed within said tool head and accessible through an aperture in said tool head;

wherein one of the first and second engagement means are formed within a spigot extending along an axis of the tool head or the tool body and received within a chamber formed within the other of the tool head or the tool body such that the spigot engages and co-operates with alignment apertures within the chamber of said other of the tool head and the tool body to restrain the spigot from axial displacement when the first and second engagement means are engaged.

2. A tool as claimed in claim 1 wherein one of the tool head and the body is received through said aperture of the other of the tool head and body for the engagement means of said one of the other of said tool head and body to be received through the aperture of the one of the tool head or the body for said complimentary engagement to occur between the first and second engagement means within the one of the tool head or body.

3. A tool as claimed in claim 2 in which the tool head has a spigot forming an internal chamber within which the second engagement means is recessed wherein said spigot and associated chamber are received within said body through said body aperture and said first engagement means is received within said tool head chamber.

4. A tool as claimed in claim 3 in which first engagement means is housed within a substantially cylindrical chamber and the tool head has a substantially cylindrical spigot for a complimentary and co-axial fit within the cylindrical chamber of the body wherein both first and second engagement means are disposed on the axis of the cylindrical chamber and cylindrical spigot respectively to provide for automatic alignment of the first and second engagement means when said spigot is received within said cylindrical tool chamber.

5. A tool as claimed in claim 1 in which one of said first and second engagement means comprises a male cog having a plurality of external gear teeth and the other of said first and second engagement means comprises a female cog meshingly engaged the plurality of external gear teeth.

6. A power tool comprising:

a tool body having a housing and a motor mounted within the housing, the motor including a rotatable output shaft, the rotatable output shaft recessed completely within a non-removable portion of the housing; and a tool head releasably attached to the tool body, the tool head including a drive spindle releasably interconnected to the rotatable output shaft, the tool head further including a spigot extending along an axis of the tool head and radially surrounding the drive spindle the spigot received within a chamber formed within the tool body such that the spigot engages and co-operates with alignment apertures within the chamber of said tool body to restrain the spigot from axial displacement when the rotatable output shaft and drive spindle are engaged.

7. The power tool of claim 6, further comprising a male cog having a plurality of gear teeth carried by the rotatable output shaft, and wherein the tool head includes a female cog carried by the drive spindle for meshingly engaging the male cog.

8. The power tool of claim 6, wherein the tool head is a drill head attachment.

9. The power tool of claim 6, wherein the tool head is a sander head attachment.

10. The power tool of claim 6, wherein the tool head is a reciprocating saw head attachment.

11. The power tool of claim 6, wherein the tool housing includes a plate member defining a circular opening providing access to the output shaft and the tool head includes a generally cylindrical portion having an outer diameter substantially equal to an inner diameter of the circular opening, the cylindrical portion received within the circular opening when the tool head is releasably attached to the tool body.

12. The power tool of claim 11, wherein the output shaft is disposed completely behind the plate member.

13. A power tool system comprising:

a common tool body having a housing and a motor mounted within the housing rotatable about a first axis, the rotatable output member axially concealed within the housing; and at least one tool head selectively and releasably attachable to the tool body, the at least one tool head having an input member rotatable about a second axis, the input member interconnectable with the output member of the motor when the at least one tool head is attached to the tool body;

wherein one of the common tool body and the at least one tool head includes a spigot extending along an axis of the tool head or the tool body and radially surrounding the associated one of the rotatable output member and the input member, the spigot including first and second portions of different outer diameters engaging alignment aperture within the other of the common tool body and the at least one tool head, the first and second portions of the spigot being axially spaced apart.

14. The power tool system of claim 13, wherein the input member is axially concealed within the at least one tool head.

15. The power tool system of claim 14, wherein the at least one tool head includes a housing defining a spigot having an aperture providing access to the input member, the spigot defining an internal chamber, the input member disposed in the internal chamber.

16. The power tool system of claim 13, wherein the tool housing includes a plate member defining a circular opening providing access to the output shaft and the at least one tool head includes a generally cylindrical portion having an outer diameter substantially equal to an inner diameter of the circular opening, the cylindrical portion received within the circular opening when the at least one tool head is releasably attached to the tool body.

17. The power tool system of claim 13, wherein the output shaft is disposed completely behind the plate member.

18. The power tool system of claim 13, wherein the first portion of the spigot has a first diameter and the second portion of the spigot has a second, larger diameter.

19. The power tool system of claim 13, wherein the spigot is formed on the at least one tool head.

20. The power tool system of claim 19, wherein alignment apertures include a stepped cylindrical wall defining first and second generally cylindrical openings for receiving the first and second portions of the spigot, respectively.

* * * * *